US007346937B1

(12) United States Patent
Pollack

(10) Patent No.: US 7,346,937 B1
(45) Date of Patent: Mar. 25, 2008

(54) INDOOR/OUTDOOR BATHTUB/HOT TUB

(76) Inventor: Donna M. Pollack, 15447 Leadwell St., Van Nuys, CA (US) 91406

( * ) Notice: Subject to any disclaimer, the term of this patent is extended or adjusted under 35 U.S.C. 154(b) by 107 days.

(21) Appl. No.: 11/433,101

(22) Filed: May 15, 2006

(51) Int. Cl.
*E04H 4/00* (2006.01)

(52) U.S. Cl. ..... 4/488; 4/498

(58) Field of Classification Search ..... 4/488–489, 4/494, 498, 506, 538, 541.1, 514
See application file for complete search history.

(56) References Cited

U.S. PATENT DOCUMENTS 4,246,663 A * 1/1981 Aragona et al. ..... 4/500

6,209,149 B1 * 4/2001 Song et al. ..... 4/498

* cited by examiner

*Primary Examiner*—Charles E. Phillips
(74) *Attorney, Agent, or Firm*—Allan M. Shapiro

(57) ABSTRACT

The bathtub/hot tub is positioned in an opening in the wall of a house. The opening has the same shape as the plan view of the bathtub/hot tub. For a circular bathtub/hot tub, the opening is semicircular. A movable cover in the form of a quarter hollow sphere is pivoted to move from the position where it covers the outer half of the bathtub/hot tub while leaving the inner half inside the house wall accessible. It is movable to an inner position where it seals against the inner portion of the bathtub/hot tub and against the opening in the house wall to leave the bathtub/hot tub accessible from outside of the wall. In either case, the inside of the house is closed against the outside ambient conditions.

15 Claims, 1 Drawing Sheet

INDOOR/OUTDOOR BATHTUB/HOT TUB

BACKGROUND OF THE INVENTION

Bathing facilities have taken various forms. Large indoor, heated pools date from antiquity. In Roman times families and social groups gathered at the baths. Soaking in the warm water was a significant part of the experience, but it was principally a social activity. In more recent years, smaller bathtubs have been provided for the purpose of bathing with soap to clean the body. With this function in mind, they were configured for the purpose of cleanliness and included the changing of the water. The smaller size is compatible with the changing of the water after each bath.

The hot tub has found resurgence in recent years as a social meeting place, with mutual soaking in a larger hot water-containing tub, without changing the water. Since the tub was larger, it usually has been placed outdoors. As a consequence, the outdoor hot tub has been provided with shelter from sun and wind. During non-use, such an outdoor hot tub has a cover to keep windblown contaminants from entering the water and to save the heat in the water. Sometimes these outdoor hot tubs are called "spas" after a town in eastern Belgium which has mineral baths. For many years, such a natural mineral bath was believed to have therapeutic effects. The modern hot tub usually does not have significant mineral content. The hot tub took advantage of the fact that resting in warm water is soothing and restful. Modern bathtubs combine the cleanliness of changing the water with the soothing pleasure of resting in the warm water filled tub.

SUMMARY OF THE INVENTION

In order to aid in the understanding of this invention, it can be stated in essentially summary form that it is directed to an indoor/outdoor bathtub/hot tub. An enclosure, such as a house, has a wall in which an opening is made. The bathtub/hot tub is positioned partly inside and partly outside of the wall. The opening in the wall provides sufficient clearance above the bathtub/hot tub to permit conventional use thereof. A movable cover is provided and is configured to be movable from a position where it covers the inside portion of the bathtub/hot tub to make it open to the outside to a position where it covers the outside portion of the bathtub/hot tub to permit the bathtub/hot tub to be accessible from the inside. In both cases, the cover encloses the opening in the wall to close the inside space from the outside.

It is, thus, a purpose and advantage of this invention to provide an indoor/outdoor bathtub/hot tub wherein the pleasures of having an indoor bathtub/hot tub and the pleasures of having an outdoor bathtub/hot tub are combined in the same bathtub/hot tub.

It is another purpose and advantage of this invention to provide an indoor/outdoor bathtub/hot tub wherein a movable cover which extends over about half of the bathtub/hot tub and encloses the wall opening so that the bathtub/hot tub is accessible only from the inside or only from the outside, depending upon movable cover position.

It is another purpose and advantage of this invention to provide a movable cover for the bathtub/hot tub which closes the opening in the wall so that the interior of the building into which the bathtub/hot tub is built is separated from the outdoors when the cover is in either of its end positions.

The features of this invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

Figure 1:
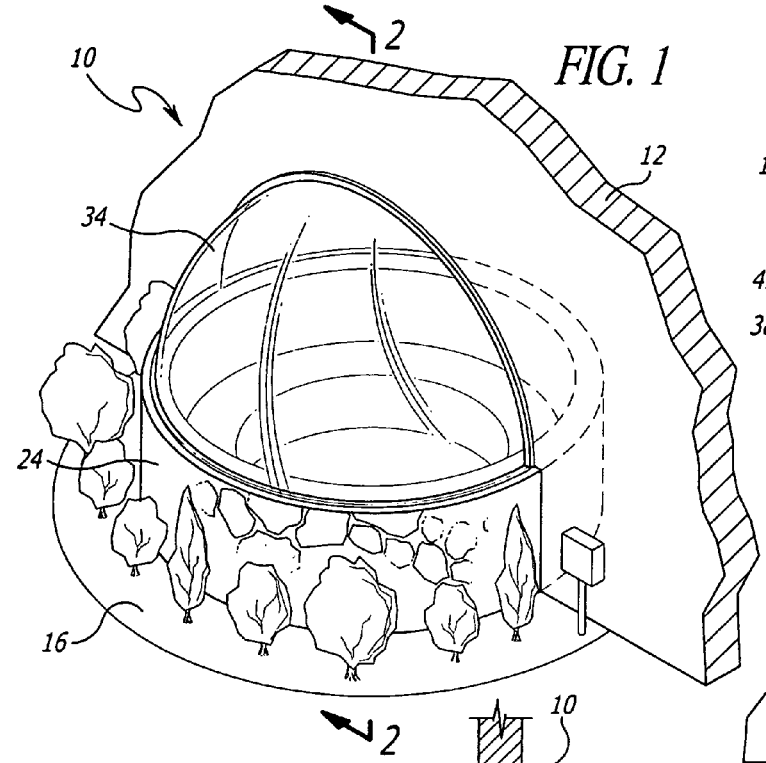
FIG. 1 is a perspective view of the indoor/outdoor bathtub/hot tub of this invention shown in association with the wall of a building.

A house 10 is represented by a wall 12. The house is a complete enclosure with floor, walls and roof so as to define an enclosed living space. Instead of a living space, it may be any other type of enclosed space, including a health club building, building for recreational activities or other building. There is a floor 14 within the building and an outside ground level 16 outside of the building. There is an opening 18 in the wall, see FIG. 3. A bathtub/hot tub 20 is comprised of a tub liner 22 and tub shell 24. The bathtub/hot tub is positioned in the opening 18. The tub shell 24 has a ledge 26 which forms the tub edge surface. In order to close the opening 18 and to separate the interior from the exterior, a cover is required, and the cover must have a seal. Thus, the top of the ledge 26 has a weather-stripping seal thereon. The seal should be interengaging and, in the present case, a liner groove 28 is formed downward in the ledge all the way around the ledge, both inside and outside of the wall. The groove is lined with a weather stripping liner.

Movable cover 34 is formed of a transparent synthetic polymer composition material. Lexan brand of polycarbonate is suitable. Transparent is preferable. The movable cover is a one-quarter hollow sphere in general configuration. It has a pivot pin 36 on which the cover is pivoted on the tub shell 24. This pivot pin defines the rotational axis of the cover, which is substantially a diameter of the quarter sphere.

Figure 3:
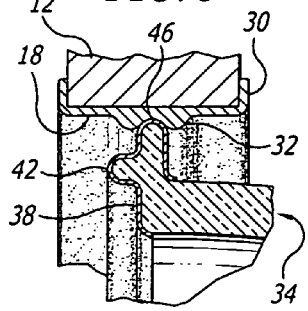
FIG. 3 is an enlarged section taken generally along line 3-3 of FIG. 2.
Figure 4:
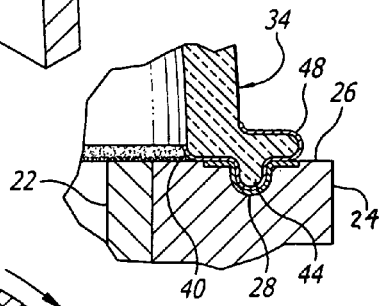
FIG. 4 is an enlarged section taken generally along line 4-4 of FIG. 2.

The cover 34 has an outside edge 38, see FIG. 3, and an inside edge 40, see FIG. 4. These edges respectively have circumferentially directed seal noses 42 and 44. The seal nose 42 engages into the liner seal groove 28 in liner 22 when the cover is in its outer end position shown in FIG. 1. The seal nose 44 engages into the liner seal groove 28 in liner 22 when the cover is in its inner end position shown in FIG. 4.

Figure 2:
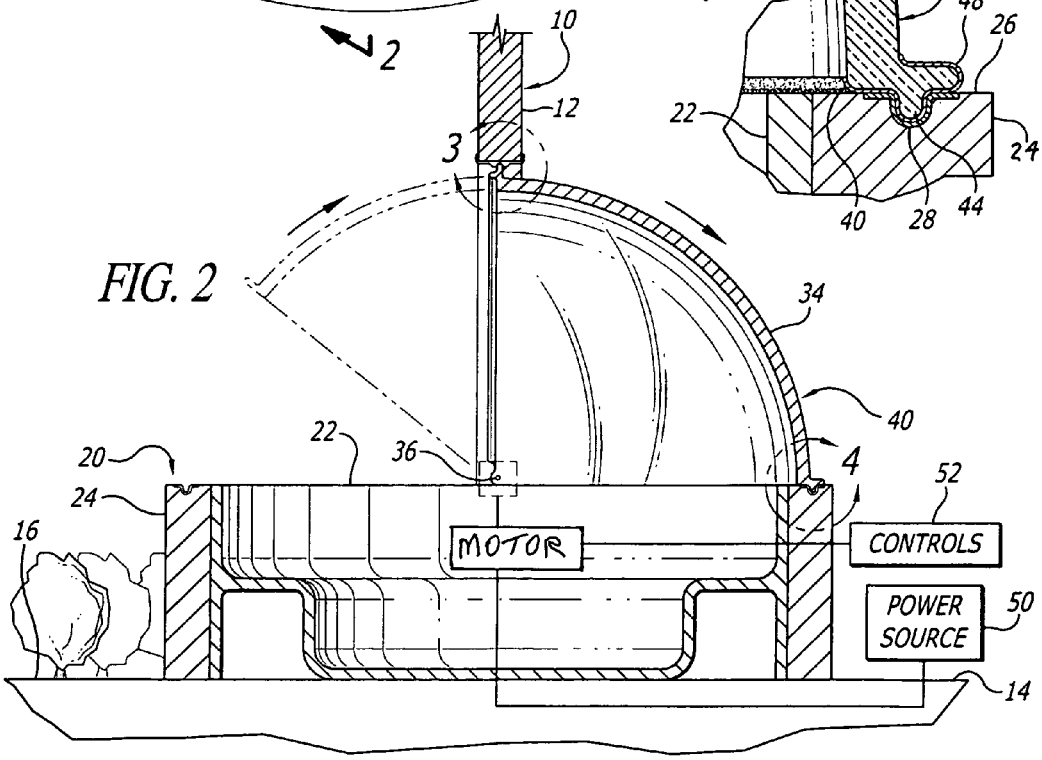
FIG. 2 is an enlarged section taken generally along line 2-2 of FIG. 1.

The cover 34 is pivotable on the pivot pin 36 from the outer position shown in FIG. 1 to the inner position shown in FIG. 2. In the outer position, the outside edge 38 engages in the groove 28 outside of the house wall. In the inner position, the nose 44 on the edge 40 engages in the liner groove 28 when the movable cover is moved into the inner position shown in FIG. 2. The nose-in-groove seals are examples of suitable weather seals for engagement between the cover and the bathtub/hot tub ledge. Other kinds of inter-engaging seals can be used. Such seals are necessarily oriented at a direction at right angle to the plane of the edge 38 and the edge 40 in order to engage as the cover moves into place against the tub shell.

A seal is also necessary around the opening 18. Liner 30 is positioned in the opening. The sealing surface is provided by the groove in the liner 30 between the ridges 32. The outside edge 38 of the cover is provided with a seal nose 46, which extends radially outward. When the outside edge 38 is in the raised position, this nose 46 engages into the seal groove between ridges 32. In similar manner, the inside edge 40 of the cover, see FIG. 4, has a seal nose 48 which extends radially outward from pivot pin 36. This nose engages against liner 30 when the movable cover is in the outside position shown in FIG. 1, opposite the position shown in FIG. 2. Any types of suitable inter-engaging weather stripping or sealing can be employed at the sealing interfaces.

In either of the end positions of motion, the movable cover 34 is sealed against the tub's edge and is sealed with respect to the wall opening. In FIG. 1, the movable cover is in the outer position where the cover encloses the outside and the tub is accessible from within the house. It is sealed around both edges. Similarly, when the movable cover is rotated to its other end position shown in FIG. 2, the cover is sealed both with respect to the tub shell and the wall. In either of the end positions, the outside is separated from the inside space. A motor is connected to the cover to move it between its two end spaces. Power source 50 provides the necessary power to the motor, and control system 52 controls the power to the motor to move the movable cover from the inside position to the outside position, and vice versa.

A circular tub and a quarter-spherical movable cover are the preferred embodiment. However, other tub shapes and other cover shapes are possible. Rectangular and elliptical and other shapes are possible. The movable cover will seal against the bathtub/hot tub ledge, with a variety of tub shapes, as long as the tub shape is symmetrical with respect to the house wall. The bathtub/hot tub 20 is a bathing tub. The tub can be used for cleanliness and/or for restful immersion. The water may be reused or changed after each usage. It can be used with soap or with clear water. It can be used with water at any tolerable temperatures. In hot ambient conditions, cold water may be preferable. In cool ambient conditions, hot water is preferable.

This invention has been described in its presently preferred embodiment, and it is clear that it is susceptible to numerous modifications, modes and embodiments within the ability of those skilled in the art and without the exercise of the inventive faculty.

What is claimed is:

1. An indoor-outdoor bathing tub and an exterior wall of a building, said wall having a building interior side and a building exterior side, an opening through said wall, said bathing tub being configured to be positioned in and through said opening so as to extend substantially equally interiorly and exteriorly through said wall, said bathing tub having a ledge therearound;

a movable cover on said bathing tub, said cover being configured to engage and seal against said ledge exteriorly of the wall and against said exterior side of said wall in a first position and being configured to engage against said ledge interiorly of said wall and against said interior side of said wall when in a second position so that, in both said first position and in said second position of said cover, said opening in said wall is closed, and, when said cover is in its said first position, said bathing tub is accessible from said interior side of said wall, and, when said cover is in its said second position, said bathing tub is accessible from said exterior side of said wall.

2. The bathing tub of claim 1 wherein said bathing tub is symmetrical with respect to a plane through the wall.

3. The bathing tub of claim 2 wherein said bathing tub is circular and said cover is a dome configured substantially in the shape of one-quarter of a hollow sphere.

4. The bathing tub of claim 2 wherein said dome has first and second edges, said first edge of said dome lies in a first plane and said second edge of said dome lies in a second plane, said first and second planes being substantially at a right angle with respect to each other.

5. The bathing tub of claim 4 wherein the intersection of said first and second planes defines a line which comprises an axis of rotation, said dome being mounted for rotation on said axis from its first position to its second position.

6. The bathing tub of claim 5 wherein said dome is made of a substantially clear synthetic polymer composition material.

7. The bathing tub of claim 1 wherein said cover is a dome which is configured substantially in the shape of one-quarter of a hollow sphere, said dome being defined by a first plane defining its first edge and a second plane defining its second edge, said planes intersecting to define a pivot axis, said dome being pivoted on a pivot on said pivot axis.

8. The bathing tub of claim 7 wherein said movable dome, said opening and said bathing tub ledge each has sealing structure thereon so that said dome is sealed with respect to said bathing tub and the wall in both of its first and second positions.

9. The bathing tub of claim 8 wherein said dome is made of a substantially clear synthetic polymer composition material.

10. The bathing tub of claim 1 wherein said movable dome, the opening and said bathing tub ledge each has sealing structure thereon so that said dome is sealed with respect to said bathing tub and the wall in both of its first and second positions.

11. The bathing tub of claim 1 wherein said cover is a dome which is mounted on a pivot to pivot from its first position to its second position.

12. The bathing tub of claim 11 wherein said dome is made of substantially transparent synthetic polymer composition material.

13. The bathing tub of claim 11 wherein said dome has a first edge and a second edge, said first edge defining a first plane and said second edge defining a second plane, said first and second planes lying substantially at a right angle with respect to each other and said intersection of said first and second planes defining a pivot axis on which said dome is pivoted.

14. The bathing tub of claim 13 wherein a motor is connected to said dome to move said dome between its first and second positions.

15. The bathing tub of claim 13 wherein said dome is made of substantially transparent synthetic polymer composition material.

* * * * *